US007390142B2

(12) United States Patent
O'Brien

(10) Patent No.: US 7,390,142 B2
(45) Date of Patent: Jun. 24, 2008

(54) UNDERGROUND STORAGE TANK ACCESS/ISOLATION RISER ASSEMBLY, METHOD, AND KIT

(76) Inventor: Patrick E. O'Brien, 16653 Caledonia Rd., Caledonia, IL (US) 61011

( * ) Notice: Subject to any disclaimer, the term of this patent is extended or adjusted under 35 U.S.C. 154(b) by 504 days.

(21) Appl. No.: 11/210,057

(22) Filed: Aug. 23, 2005

(65) Prior Publication Data

US 2007/0053747 A1 Mar. 8, 2007

(51) Int. Cl.
*B65G 5/00* (2006.01)

(52) U.S. Cl. ..... 405/53; 220/567.1; 220/567.2

(58) Field of Classification Search ..... 405/52–55, 405/40, 41; 220/567.1, 567.2
See application file for complete search history.

(56) References Cited

U.S. PATENT DOCUMENTS

| | | | | |
|---|---|---|---|---|
| 4,501,305 | A | | 2/1985 | Zola et al. |
| 4,527,708 | A | | 7/1985 | Dundas et al. |
| 4,579,155 | A | | 4/1986 | Zola |
| 4,615,362 | A | | 10/1986 | Hartman et al. |
| 4,655,361 | A | | 4/1987 | Clover et al. |
| 4,685,585 | A | | 8/1987 | Robbins |
| 4,706,718 | A | | 11/1987 | Milo |
| 4,717,036 | A | | 1/1988 | Dundas et al. |
| 4,762,440 | A | | 8/1988 | Argandona |
| 4,770,317 | A | | 9/1988 | Podgers et al. |
| 4,793,387 | A | | 12/1988 | LeBlanc et al. |
| 4,796,676 | A | * | 1/1989 | Hendershot et al. ..... 220/723 |
| 4,871,084 | A | | 10/1989 | Robbins |
| 4,958,957 | A | | 9/1990 | Berg et al. |
| 4,999,900 | A | | 3/1991 | Anderson |
| 5,058,633 | A | | 10/1991 | Sharp |
| 5,098,221 | A | | 3/1992 | Osborne |
| 5,114,271 | A | | 5/1992 | Sunderhaus et al. |
| 5,204,000 | A | * | 4/1993 | Steadman et al. ..... 210/519 |
| 5,217,052 | A | | 6/1993 | Sharp |
| 5,222,832 | A | | 6/1993 | Sunderhaus et al. |
| 5,363,093 | A | | 11/1994 | Williams et al. |
| 5,372,453 | A | | 12/1994 | Argandona |
| 5,544,974 | A | | 8/1996 | Berg et al. |
| 5,595,088 | A | | 1/1997 | Horner |
| 5,595,456 | A | | 1/1997 | Berg et al. |
| 5,882,045 | A | | 3/1999 | Bravo |
| 5,944,361 | A | | 8/1999 | Bravo |
| 5,975,132 | A | | 11/1999 | Gleeson |
| 6,047,724 | A | * | 4/2000 | Nurse, Jr. ..... 405/53 |
| 6,109,290 | A | * | 8/2000 | Sabatinelli ..... 137/234.6 |
| 6,171,029 | B1 | * | 1/2001 | McGill et al. ..... 405/55 |

(Continued)

*Primary Examiner*—Frederick L Lagman
(74) *Attorney, Agent, or Firm*—Meroni & Meroni, P.C.; Charles F. Meroni, Jr.; Christopher J. Scott

(57) ABSTRACT

An underground storage tank riser assembly comprises a riser member and at least one riser alignment spacer assembly. The riser member comprises an inferior riser end and an outer riser surface. The outer riser surface at the inferior riser end comprises a plurality of paired, optionally color-coded, curvilinear score indicia. The curvilinear score indicia enable a user to remove paired inferior end portions from the inferior riser end for forming a tank-engaging, saddle-shaped mouth at the inferior riser end. The saddle-shaped mouth comprises a vertical riser radius of curvature substantially equal in magnitude to a determinable tank radius of curvature. The saddle-shaped mouth is engageable with an outer tank surface in radial adjacency to a conduit extending therefrom. The riser alignment spacer assembly functions to center the riser member relative to the conduit.

35 Claims, 8 Drawing Sheets

U.S. PATENT DOCUMENTS

| | | | | |
|---|---|---|---|---|
| 6,374,187 | B1 | 4/2002 | Knight et al. | |
| 6,655,418 | B1 | 12/2003 | McGill et al. | |
| 6,840,293 | B1 | 1/2005 | Smith | |
| 2003/0136789 | A1 * | 7/2003 | Bolzer et al. | 220/567.1 |
| 2004/0200842 | A1 | 10/2004 | Low et al. | |
| 2004/0234338 | A1 | 11/2004 | Monroe et al. | |
| 2005/0205581 | A1 * | 9/2005 | McRae | 220/567.1 |
| 2006/0285927 | A1 * | 12/2006 | Hisgrove et al. | 405/53 |

* cited by examiner

FIG. 6
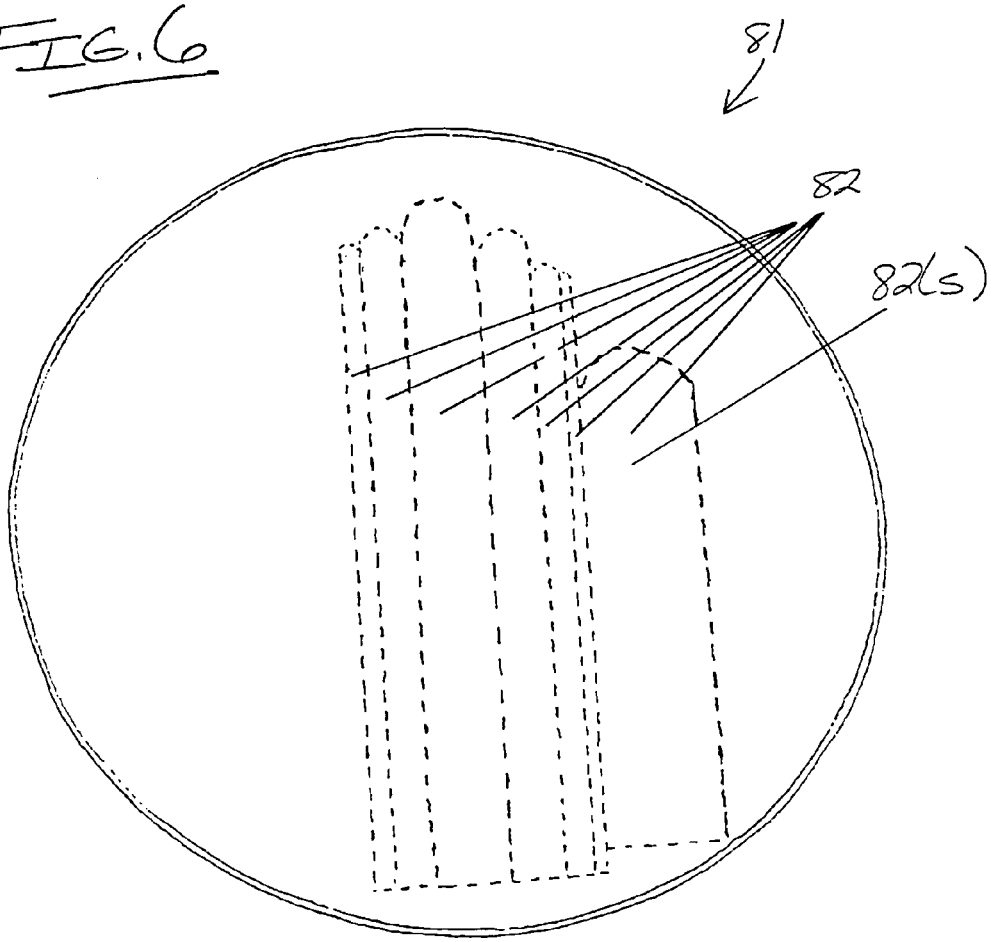
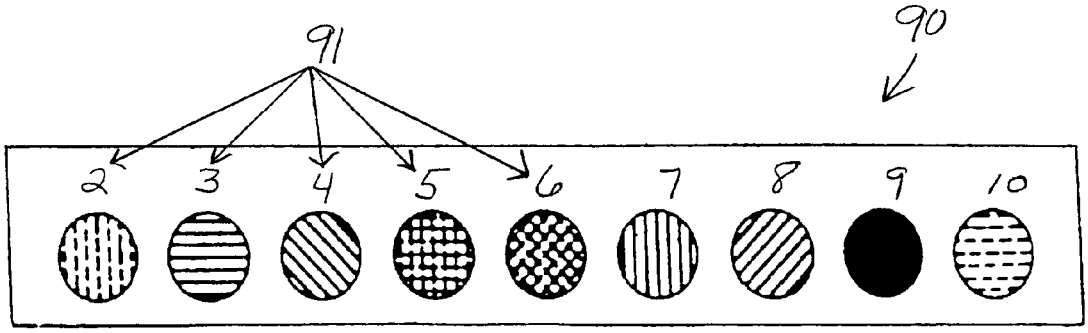
FIG. 6(a)

UNDERGROUND STORAGE TANK ACCESS/ISOLATION RISER ASSEMBLY, METHOD, AND KIT

BACKGROUND OF THE INVENTION

1. Field of the Invention

The present invention generally relates to an access/isolation riser assembly for use in combination with an underground storage tank. More particularly, the present invention relates to an access/isolation riser assembly and kit for outfitting any number of underground storage tanks enabling users thereof to gain access to the given underground storage tank and isolate certain storage tank accessibility from certain underground elements.

2. Description of the Prior Art

The prior art specifically directed to underground storage tank access riser assemblies is relatively undeveloped as compared to the prior art more broadly directed to underground storage tank spill containment art and the like. A brief listing of certain prior art specifically relating to underground storage tank riser assemblies and the like, is briefly described, hereinafter.

U.S. Pat. No. 4,685,585 ('585 Patent), which issued to Robbins, discloses a Double Wall Tank Manway System. The '585 Patent teaches a double wall manway assembly for double wall tanks intended primarily for underground use, wherein an inner wall provides primary fluid containment and an outer wall provides secondary fluid containment, and a monitor between the walls can detect leakage past the inner wall into the space between the walls. The double wall manway assembly of the invention includes a riser conduit extending through apertures in the two tank walls and having an in-turned inner flange and an out-turned outer flange, with inner and outer cover members removably sealingly engaged over the respective inner and outer flanges. The space within the riser between the two covers communicates with the space between the two tank walls through one or more vent holes through the wall of the riser, for conducting any fluid leakage through the inner cover flange seal to the monitor between the tank walls. In some forms of the invention, a plurality of pipe fittings is embodied in the double wall manway as structural parts thereof.

U.S. Pat. No. 5,595,456 ('456 Patent), which issued to Berg et al., discloses a Water—Tight Riser for Underground Storage Tank Manway. The '456 Patent teaches an underground storage tank provided with a manway equipped with a riser extending from the storage tank, about the manway, to a point just below the access way provided in the ground level of the installation. The riser is provided with a water-tight cover which is released through operation of a cam. The water-tight riser excludes water from the interior of the riser and the manway, ensuring access to the manway, operation of the fittings provided in the manway, an additional containment of fluid passing through the manway and the area of the tank adjacent thereto. Because it is water-tight, an alarm sensitive to liquid may be placed in the interior of the riser to alert the operator to the possible loss of containment, or loss of water-tight sealing between the cover and the riser.

U.S. Pat. No. 5,882,045 ('045 Patent), which issued to Bravo, discloses Secondary Containment for Underground Storage Tank Riser. The '045 Patent teaches a secondary containment system for use in preventing leakage to or from an underground storage tank at a joint where a riser line connects to the tank. The system includes a secondary riser tube for surrounding the riser line and a sealing ring for providing a seal between the outer wall of the storage tank and the secondary riser tube. The sealing ring has a sleeve for sealing against the outer wall of the secondary sealing tube and a flexible bell-shaped skirt for sealing against the outer wall of the storage tank. A support bracket clamps to the outer wall of the riser line and includes three threaded arms extending radially outward. Three acorn nuts cooperate with the threaded arms and can be jacked in an outward direction against the inner wall of the secondary riser tube to fix the riser line and the secondary riser tube to one another and hold the secondary riser tube pressed downwardly to hold the flexible skirt of the sealing ring into sealing engagement with the outer wall of the storage tank.

Related to the '045 Patent is U.S. Pat. No. 5,944,361 ('361 Patent), which also issued to Bravo, and discloses Secondary Containment for Underground Storage Tank Riser. The '361 Patent further teaches a secondary containment system for use in preventing leakage to or from an underground storage tank at a joint where a riser line connects to the tank. The system includes a secondary riser tube for surrounding the riser line and a sealing ring for providing a seal between the outer wall of the storage tank and the secondary riser tube. The sealing ring has a sleeve for sealing against the outer wall of the secondary sealing tube and a flexible bell-shaped skirt for sealing against the outer wall of the storage tank. A support bracket clamps to the outer wall of the riser line and includes three arms extending radially outward. The three arms engage the secondary riser tube to hold it into engagement with the sealing ring and thereby hold the sealing ring in sealing engagement with the tank wall by maintaining a downward force on the secondary riser tube.

It will be seen from a further review of the above-referenced patents and other prior art generally known to exist relating to underground storage tank riser assemblies, that the prior art does not teach a storage tank access system or kit for enabling installers of riser assemblies to quickly outfit variously sized underground storage tank assemblies with a riser assembly having tank saddle means. Thus, the prior art perceives a need for a storage tank access system or kit and methodology for enabling installers of riser assemblies to quickly outfit variously sized underground storage tank assemblies with a riser assembly having tank saddle means.

SUMMARY OF THE INVENTION

Accordingly, it is an object of the present invention to provide a storage tank access system and/or kit and methodology for enabling installers of riser assemblies to quickly outfit variously sized underground storage tank assemblies with a riser assembly having certain tank saddle means. Thus, it is contemplated that the present invention discloses a storage tank access system and/or kit along with certain methodology for outfitting underground storage tanks, thereby enabling access to underground storage. The storage tank access system of the present invention is cooperatively associated with an underground system-receiving cavity spatially located intermediate inferior backfill material and a superior surface layer. The storage tank access system essentially comprises, in combination, an underground storage tank assembly and an access/isolation riser assembly. The underground storage tank assembly comprises a storage tank and a matter-conducting conduit. The storage tank comprises an outer tank surface, an inner tank surface, and a substantially circular transverse tank cross-section. The transverse tank cross-section has a substantially uniform tank radius. The matter-conducting conduit comprises a superior conduit end, an inferior conduit end, and a longitudinal conduit axis. The matter-conducting conduit extends radially outward from the outer tank surface, generally in an upward and vertical direction. The inferior conduit end is in communication with the inner tank surface for conducting matter intermediate the inner tank surface and the superior conduit end.

The access/isolation riser assembly comprises a cylindrically shaped access/isolation riser member and riser alignment spacer means. The access/isolation riser member comprises a superior riser end, an inferior riser end, an inner riser surface, an outer riser surface, and a substantially uniform riser diameter. The superior riser end defines a conduit access aperture and the outer riser surface at the inferior riser end comprises a plurality of paired curvilinear score. The score indicia extend intermediate first and second oppositely oriented vertices. The score indicia are paired based upon a plurality of angles of inclination, the angles of inclination extending intermediate the inferior riser end and the curvilinear score indicia at the first and second lateral vertices. The curvilinear score indicia enable a user to remove paired inferior end portions from the inferior riser end for forming a tank-engaging, saddle-shaped mouth at the inferior riser end. The tank-engaging, saddle-shaped mouth comprises a vertical riser radius of curvature substantially equal in magnitude to the determinable tank radius of curvature. The tank-engaging, saddle-shaped mouth is engageable with the outer tank surface radially adjacent the matter-conducting conduit. The riser alignment spacer means function to center the riser member relative to the conduit axis, the riser and conduit axes thus being substantially collinear.

Other objects of the present invention, as well as particular features, elements, and advantages thereof, will be elucidated or become apparent from, the following description and the accompanying drawing figures.

BRIEF DESCRIPTION OF THE DRAWINGS

Other features of my invention will become more evident from a consideration of the following brief description of my patent drawings, as follows:

FIG. 6 is a top plan view of a crossover conduit template showing a number of variously dimensioned conduit pull-outs.

FIG. 6(*a*) is a plan view of a color code key showing a number of various colors associated with a number of generic tank diameter dimensions.

DETAILED DESCRIPTION OF THE PREFERRED EMBODIMENT(S)

Figure 10:
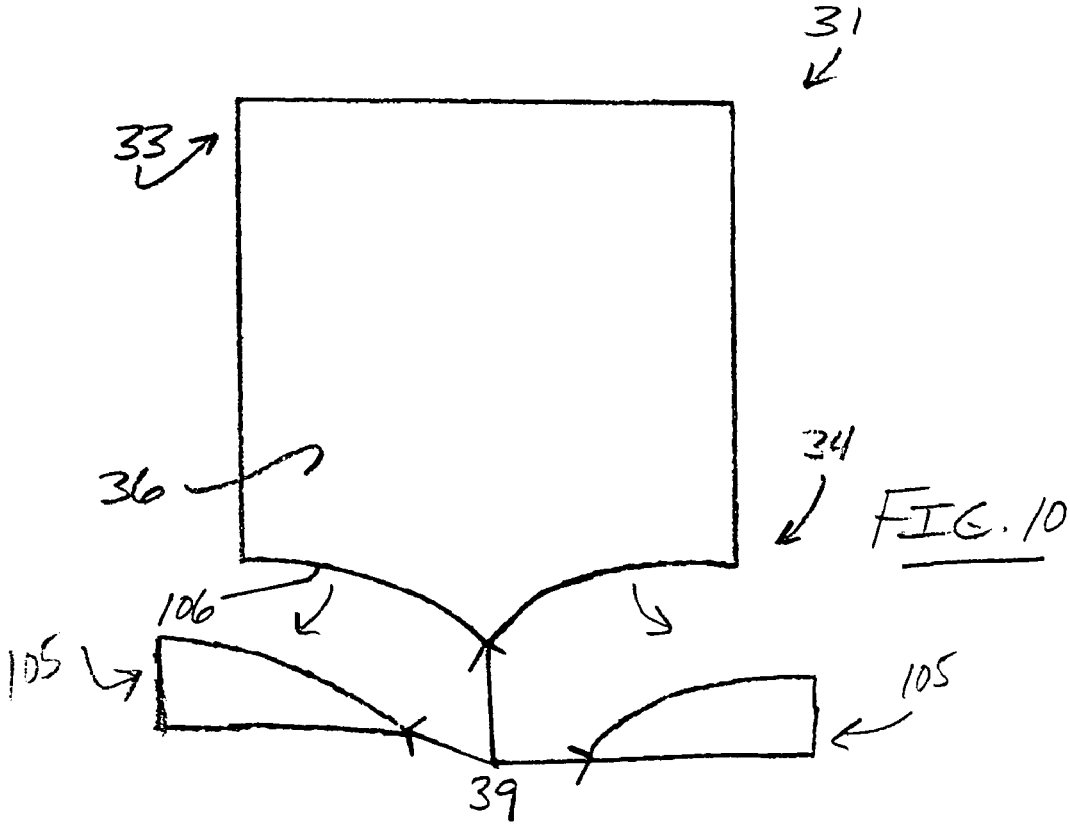
FIG. 10 is a side diagrammatic view of the riser member shown in FIG. 9 with the paired removable inferior end portions removed from the inferior riser end of the riser member.

Referring now to the drawings, a preferred embodiment of the present invention concerns an underground storage tank access system 10 as generally illustrated and referenced in FIG. 10. It is contemplated that certain elements of storage tank access system 10 can be provided in the form of a kit and thus a storage tank access kit for outfitting an underground storage tank 11 is contemplated. In other words, it is contemplated that the present invention enables users, when outfitted upon underground storage tank assembly 20, to more properly access underground storage. In this regard, FIG. 1 attempts to depict a fragmentary view of the superior portions of a generic underground storage tank assembly 20 with certain elements of the kit attached to the superior portions of storage tank assembly 20 in an assembled state. In this regard, it is noted that underground storage tanks comprise various sizes and shapes.

For example, the diameter of any given storage tank (and thus, its radius of curvature) is very often not immediately apparent from a casual visual inspection of the outer surfaces of a storage tank, and must first be calculated or researched. The diameter can very easily be calculated by measuring a riser pipe length and by measuring the distance of the top of the riser pipe to the bottom of the storage tank, the diameter of the storage tank being the difference between these two figures. Once the diameter of the tank is found, then the radius of curvature can be determined. The radius of curvature for any given cylindrical storage tank as embedded underground in a storage tank-receiving cavity as generally referenced at 100 in FIG. 1. It will be understood from an inspection of FIG. 1 that the underground storage system-receiving cavity or underground storage tank-receiving cavity 100 may essentially be defined by the displaced earth and/or fill material otherwise occupied by underground storage tank assembly 20 and various tank access components cooperatively associated therewith as described in more detail hereinafter. Thus, it will be understood that reference numeral 100 references the boundary between the underground storage tank 20 and/or system of the present invention and the surrounding tank/system concealing materials as generally further referenced at 101. It will be noted that underground system-receiving cavity 100 is spatially located intermediate inferior backfill material 101 and a superior surface layer 110 as further referenced in FIG. 1. Superior surface layer 110 preferably comprises a superior layer surface 111, an inferior layer surface 112, and a substantially uniform surface layer thickness 113 all as further illustrated and referenced in FIG. 1. It will be understood from a consideration of FIG. 1 that the surface layer thickness 13 extends intermediate the superior layer surface 111 and the inferior layer surface 112.

Figure 1:
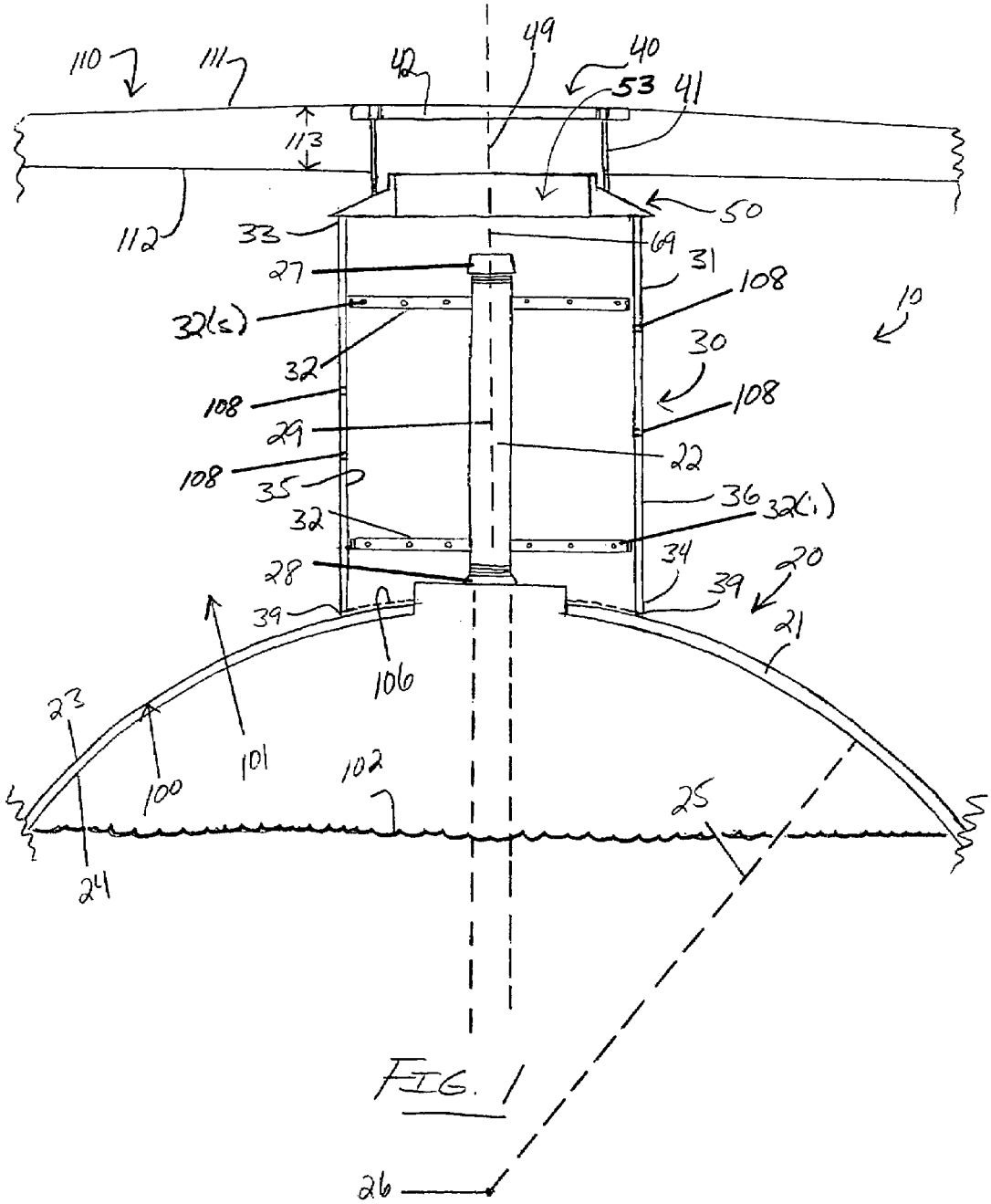
FIG. 1 is a fragmentary cross-sectional side view of a preferred storage tank access system as viewed from underground showing a storage tank, a storage tank access/isolation riser assembly, an optional riser top cap reducer, and a manhole assembly.
Figure 2:
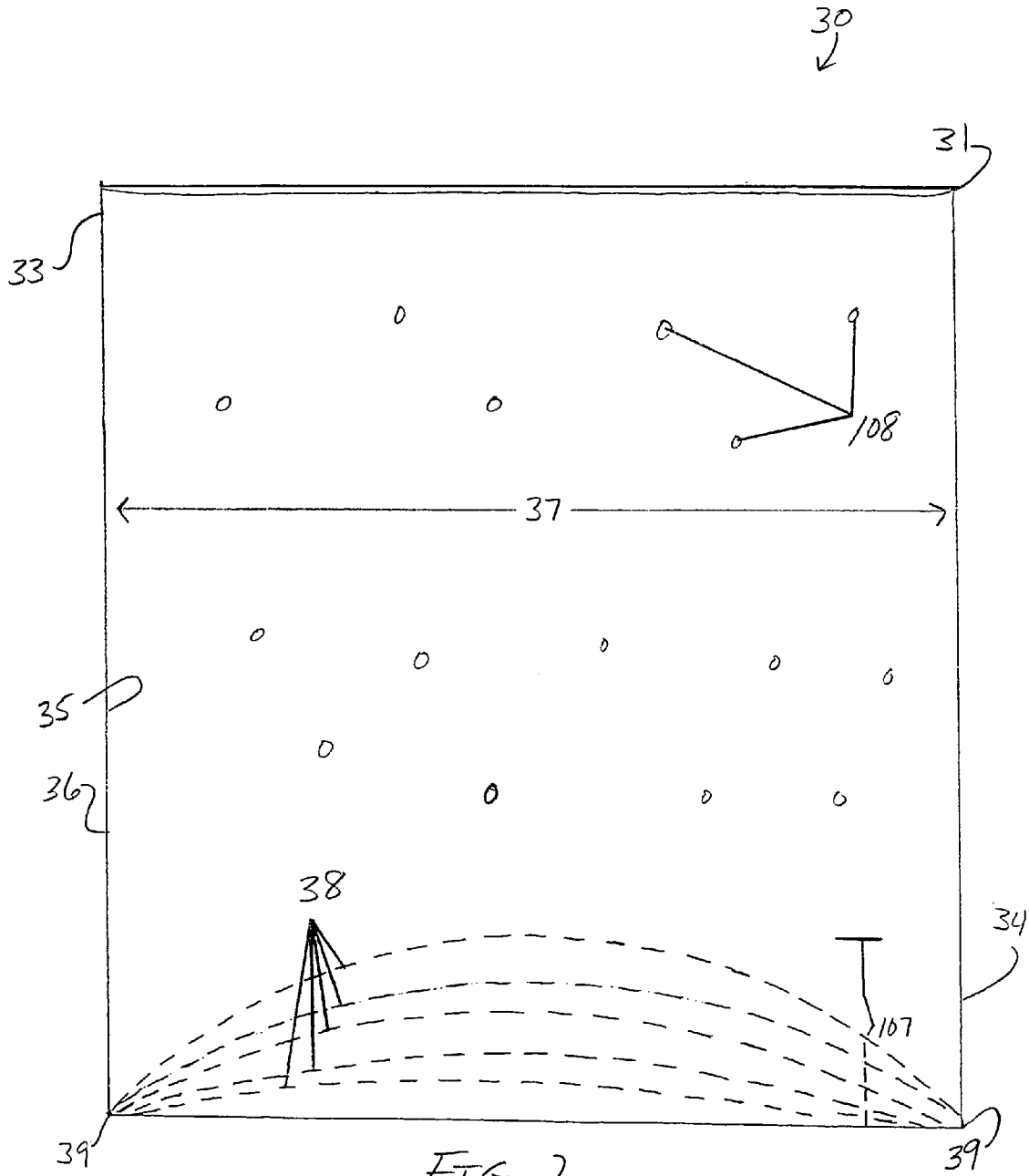
FIG. 2 is a side plan view of a riser member of the access/isolation riser assembly showing certain score indicia.

When viewed as a system, the present invention contemplates the combination of underground storage tank 20 with an access/isolation riser assembly 30 as generally illustrated and referenced in FIGS. 1 and 2. Further elements of the storage tank access system 10 necessarily include a manhole assembly 40 as illustrated and referenced in FIG. 1 and optionally include a riser top cap reducer 50 as illustrated and referenced in FIGS. 1, 3, and 4.

Underground storage tank assembly 20 may be constructed from any of the state of the art materials currently used in the construction of storage tanks, so long as the same is capable of withstanding certain forces directed there against by earthen materials and/or kit components located in superior adjacency thereto. Underground storage tank assembly 20 preferably comprises a storage tank 21 and a matter-conducting conduit 22, both of which are generally illustrated and referenced in FIGS. 1 and 12. Storage tank 21 inherently comprises an outer tank surface 23 as illustrated and referenced in FIGS. 1 and 12; an inner tank surface 24 as referenced in FIG. 1; and, preferably, a substantially circular transverse tank cross-section as further generally referenced in FIG. 1. In this regard, it is contemplated that most underground storage tanks (such as petroleum-storing storage tanks) are generally cylindrical along the longitudinal axis thereof (as referenced at 26 in FIG. 1) and thus a transverse cross-section at any point along the longitudinal axis 26 of a typical underground storage tank 20, will render a substantially circular transverse tank cross-section. Further, given a substantially cylindrical storage tank, a substantially uniform tank radius will be evident as generally referenced at 25 in FIG. 1. Notably, a circle with a given radius will inherently have a given radius of curvature at the circle boundary. Thus, it is further noted that since there are variously sized storage tanks, most of which are cylindrical in nature (along the longitudinal axis thereof), then the outer tank surface of a storage tank with a substantially uniform radius will inherently have a corresponding substantially uniform tank radius of curvature. Notably, petroleum-storing storage tanks are common examples of underground storage tanks. In this regard, it is intended that petroleum-storing storage tanks have been here cited as exemplary structure and not as limiting structure.

Figure 12:
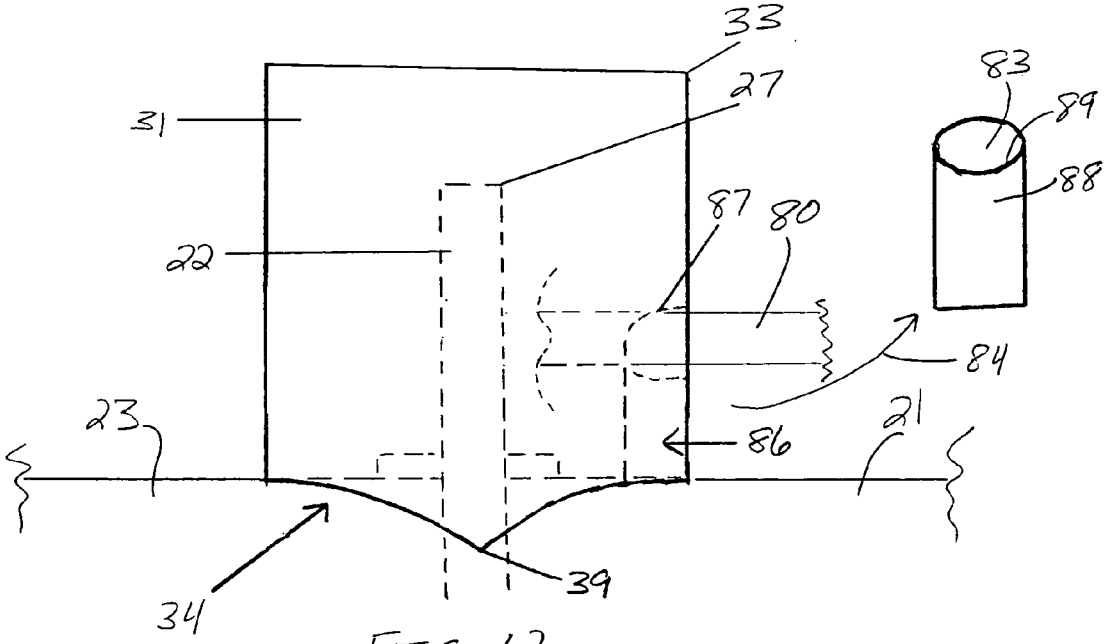
FIG. 12 is a fragmentary side diagrammatic depiction of the riser member seated upon a storage tank with a crossover conduit extending therefrom with certain portions shown in broken lines to depict hidden or removed structure(s).

The matter-conducting conduit 22 inherently comprises a superior conduit end 27 as illustrated and referenced in FIGS. 1 and 12; an inferior conduit end 28 as illustrated and referenced in FIG.1; and a longitudinal conduit axis 29 as further illustrated in FIG. 1. It will be seen from an inspection of FIG. 1 that matter-conducting conduit 22 preferably extends superiorly (or vertically upward) and radially outward from outer tank surface 23. Further, inferior conduit end 28 is preferably in communication with inner tank surface 24 as it will be understood that matter-conducting conduit 22 is designed for conducting matter (usually a liquid petroleum product as generally depicted at 102 in FIG. 1) intermediate inner tank surface 24 and superior conduit end 27.

Figure 5:
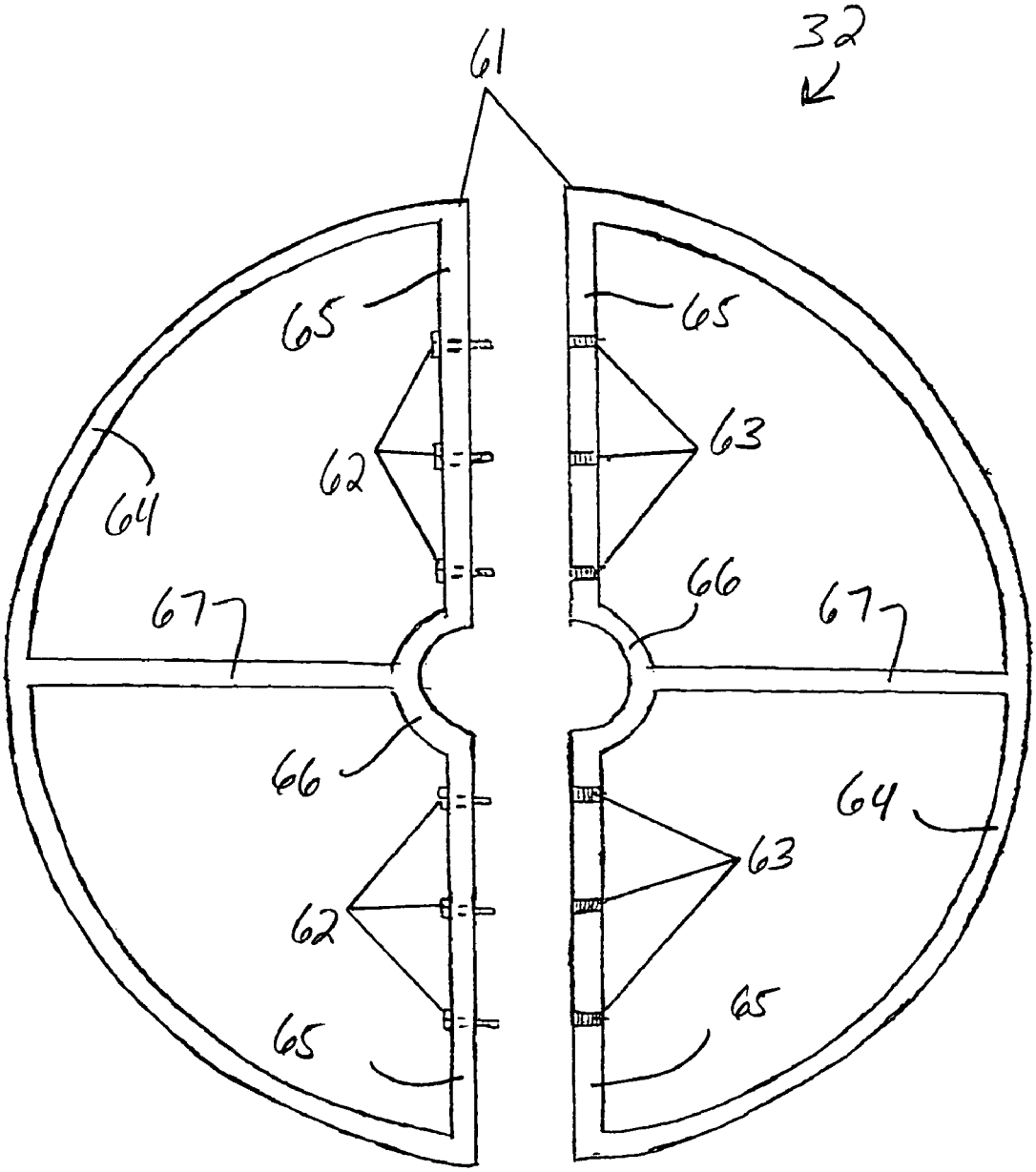
FIG. 5 is a top plan view of a preferred riser alignment spacer assembly showing two cooperatively associated semicircular riser alignment spacer members.

Access/isolation riser assembly 30 preferably comprises a cylindrically shaped access/isolation riser member 31 and certain riser alignment spacer means. In this last regard, it is contemplated that a preferred definition of the riser alignment spacer means may be had by way of at least one at least one, but preferably two riser alignment spacer assemblies 32. Access/isolation riser member 31 is illustrated and referenced in FIGS. 1, 2, 7-10, and 12. Two riser alignment spacer assemblies 32 are illustrated in FIG. 1 and a top plan view of a single riser alignment spacer assembly 32 is illustrated in FIG. 5.

Access/isolation riser member 31 is preferably constructed from high density polyethylene, or fiberglass, and preferably comprises an amendable superior riser end 33 as illustrated and referenced in FIGS. 1, 2, 7-10, and 12; an amendable inferior riser end 34 as illustrated and referenced in FIGS. 1, 2, 7-10, and 12; an inner riser surface 35 as illustrated and referenced in FIGS. 1 and 2; an outer riser surface 36 as illustrated and referenced in FIGS. 1, 2, and 7-10; a substantially uniform riser diameter 37 as generally referenced in FIG. 2; a riser axis; and water permeation means. The water permeation means as preferably defined by any number of apertures 108 (as illustrated and referenced in FIGS. 1 and 2), which extend from inner riser surface 35 to outer riser surface 36 for allowing water to permeate intermediate inner riser surface 35 and outer riser surface 36. It will be understood from a cursory inspection of FIG. 1 that superior riser end 33 essentially defines a conduit access aperture or tank access aperture for enabling users to gain access to superior conduit end 27 (and thus matter within inner tank surface 24). It will be further seen from an inspection of FIG. 1 that superior conduit end 27 is located in inferior adjacency to superior riser end 33. Users may thus readily gain access to superior conduit end 27 via superior riser end 33.

Figure 7:
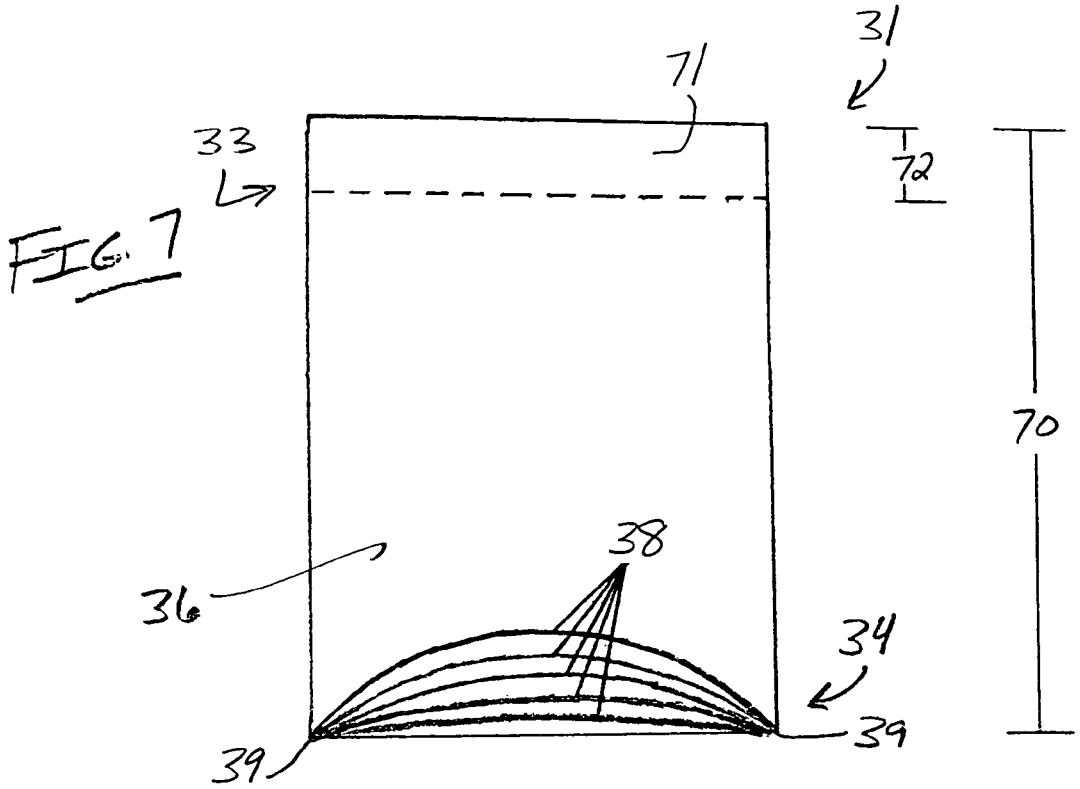
FIG. 7 is a side plan diagrammatic view of a riser member depicting a removable superior section and certain score indicia adjacent an inferior riser end of the riser member.
Figure 11:
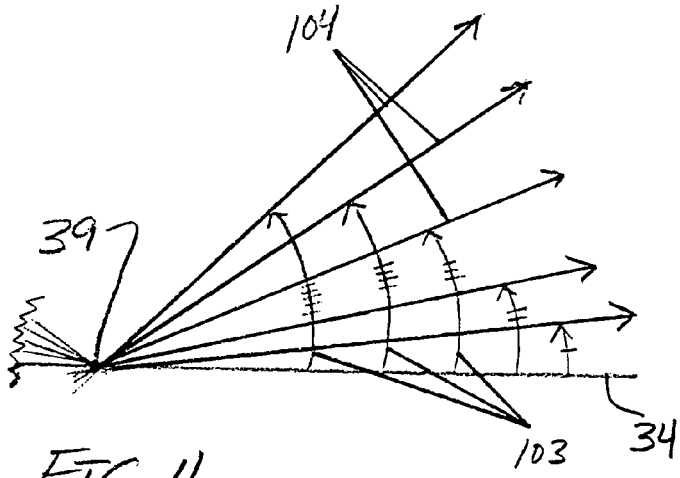
FIG. 11 is a fragmentary diagrammatic depiction of certain angles of inclination cooperatively associated with certain score indicia as found upon the outer riser surface of the riser member.

It is contemplated that a key feature of the present invention occurs at outer riser surface 36 at inferior riser end 34. In this regard, it will be understood from a comparative consideration of FIGS. 1 and 2, and FIGS. 7 and 8 that outer riser surface 36 at inferior riser end 34 preferably comprises a plurality of paired curvilinear score indicia 38 and first and second lateral vertices 39 (for purposes of clarity, a single pairing of curvilinear score indicia are depicted in FIG. 7). FIGS. 1, 2, and 7-11 reference vertices (or a single vertex) 39 and score indicia 38 are referenced in FIGS. 2 and 7-9. Notably, FIG. 9 references a single vertex 39 and FIG. 10 depicts the single vertex in FIG. 9 as being divided into three parts when certain structure is removed from inferior riser end 34. It will be understood from a consideration of the noted figures that the curvilinear score indicia 38 extend intermediate the first and second lateral vertices 39. It will be further understood from a consideration of noted figures that the paired nature of the score indicia 38 are based upon a plurality of angles of inclination 103 as generally depicted in FIG. 11. The angles of inclination 103 extend intermediate the terminus of inferior riser end 34 and the curvilinear score indicia 38 at the first and second lateral vertices 38. In other words, the angles of inclination 103 are defined by varying angle(s) between the tangent lines 104 at the respective arc lengths of the curvilinear indicia (lines) passing through vertices 39, as generally depicted in FIG. 11.

Figure 8:
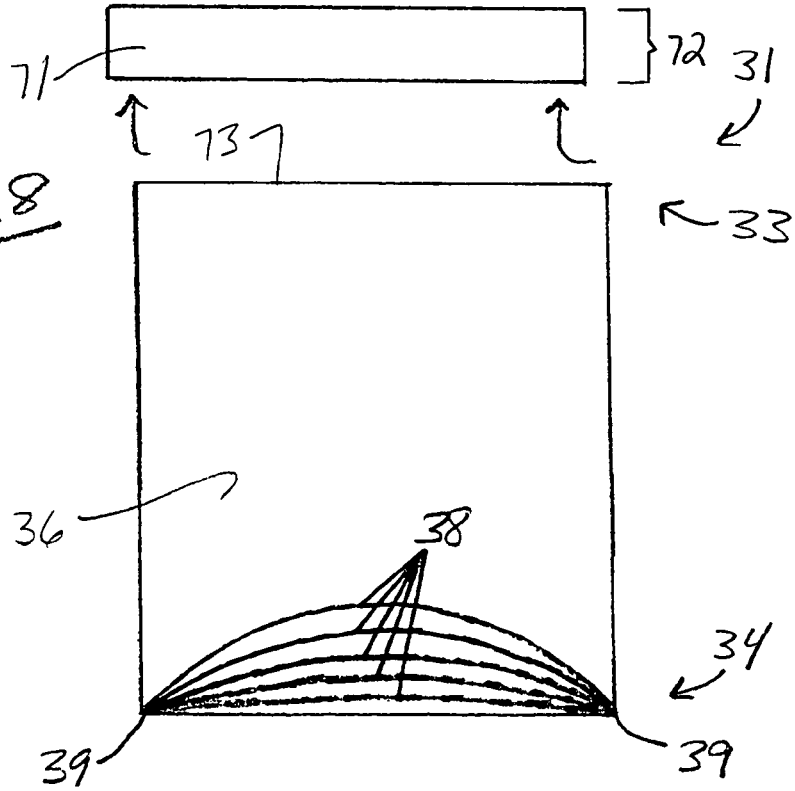
FIG. 8 is a side diagrammatic view of the riser member shown in FIG. 7 with the removable superior section removed from the riser member.
Figure 9:
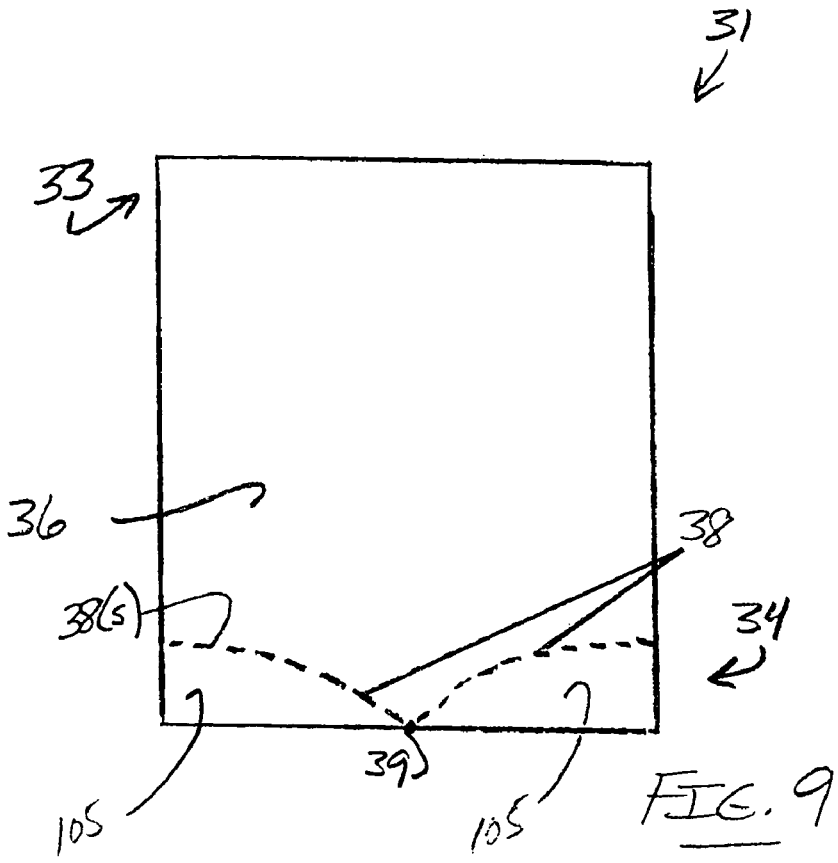
FIG. 9 is a side plan diagrammatic view of a riser member depicting paired removable inferior end portions of the inferior riser end of the riser member as scored by selectively paired score indicia.

The curvilinear score indicia 38 enable or guide a user to remove paired inferior end portions 105 from inferior riser end 34 as generally depicted in FIG. 10. It will be understood from a comparative inspection of FIGS. 9 and 10 that, given a selectively paired set of score indicia 38, the installer may cut along the selected score indicia 38*s* (as specifically referenced in FIG. 9) and remove semicircular wedge-shaped portions (i.e. paired inferior end portions 105). To avoid accidental removal of unpaired inferior riser end removal portions, it is contemplated that score indicia 38 may be color-coded for enabling the user to more accurately remove the paired inferior end portions 105. In this regard, to bolster the effectiveness of the color-coded score indicia 38, it is contemplated that a color-code key 90 may be included in the system or kit of the present invention as generally illustrated and referenced in FIG. 6(*a*). In other words, while color-coded score indicia may be helpful in their own right, it is contemplated that color code key 90 enhances the user's ability to ascertain removable end portions by being provided color codes for various tank diameters 91 as generally further referenced in FIG. 6(*a*). It should perhaps be noted that while FIGS. 2, 7, and 8 show a series of five (5) score indicia 38, more or less score indicia 38 are possible. The noted figures show five (5) score indicia 38 for illustrative purposes only. For example, score indicia 38 may very well comprise nine (9) score indicia 38 to correspond to color code key 90 (having nine (9) color codes). Thus, it will be understood that the storage tank access system and/or kit of the present invention may comprise a color code key and the score indicia 38 may be cooperatively associated therewith for enabling the user to more easily remove the paired inferior end portions.

The removed paired inferior end portions 105 essentially form a tank-engaging, saddle-shaped mouth 106 at the inferior riser end 34 as referenced in FIGS. 1 and 10. The tank-engaging, saddle-shaped mouth 106 inherently comprises a vertical riser radius of curvature in the place extending through the first and second lateral vertices 39. In other words, when viewed from an extreme lateral viewpoint, the radius of curvature has a viewable vertical dimension 107 as depicted at the radius of curvature of least magnitude in FIG. 2. Notably, from an inspection of FIG. 1, it will be seen that the selected score indicia 38 will result in a vertically apparent or vertical riser radius of curvature that is substantially equal to the tank radius of curvature and thus, the tank-engaging, saddle-shaped mouth 106 will snugly and engageably seat upon outer tank surface 23 in radial adjacency to matter-conducting conduit 22. The riser alignment spacer means as previously introduced function to center riser member 31 relative to the conduit axis 25 and thus, the riser axis and conduit axis 29 are substantially collinear. In this regard, the riser axis is referenced at 69 in FIG. 1.

It will be recalled that the riser alignment spacer means may preferably be defined by at least one, but preferably two riser alignment spacer assemblies 32, one of which has been illustrated in FIG. 5. In this regard, the reader is again directed to FIG. 1 in which it will be seen that the riser alignment spacer means may be defined by a superior riser alignment spacer assembly 32(*s*) and an inferior riser alignment spacer assembly 32(*i*). In this regard, it will be seen that superior riser alignment spacer assembly 32(*s*) is preferably spatially located in inferior adjacency to superior conduit end 27 and inferior riser alignment spacer assembly 32(*i*) is preferably spatially located in superior adjacency to inferior conduit end 28. Each riser alignment spacer assembly 32 preferably comprises first and second semicircular spacer members 61 and spacer attachment means or certain means for attaching the spacer members to one another. In this last regard, it is contemplated that nut and bolt or screw type fasteners 62 (with cooperative bolt-receiving structure 63 as formed in radial members 65) may define the spacer attachment means as are further referenced in FIG. 5. The first and second spacer members 61 each preferably comprise a semicircular riser-engaging portion 64, a conduit-engaging portion 66 (typically semicircular depending on the transverse cross section of matter-conducting conduit 22). Each spacer member 61 may further preferably comprises spacer reinforcement means, which may preferably be defined by radially extending reinforcement spoke(s) 67 as illustrated and referenced in FIG. 5. Notably, the spacer reinforcement means may also be defined by the cooperative interaction of radial members 65 and reinforcement spokes 67. The spacer reinforcement means are designed to maintain a uniform distance intermediate riser-engaging portions 64 and conduit-engaging portions 66. Together, riser member 31 and the riser alignment spacer means function to isolate matter-conducting conduit 22 from the backfill material as referenced at 101. Each spacer member 61 is preferably constructed from cast plastic and the fasteners for holding the spacer members 61 together are preferably stainless steel screws or the like.

Manhole assembly 40 preferably comprises a cylindrical manhole skirt 41 and a substantially circular, bolt-down type manhole lid 42 as illustrated and referenced in FIG. 1. It is contemplated that manhole assembly 40 may be constructed as a typical state of the art manhole assembly provided that the manhole skirt 41 comprises an inferior skirt end, a superior skirt end, a skirt gateway or through means, a longitudinal skirt axis 49 (as referenced in FIG. 1), and a skirt diameter; and manhole lid 42 comprising a lid diameter and a lid center. It will thus be understood from a consideration of FIG. 1 as well as a consideration of the state of manhole art that manhole skirt 41 preferably extends intermediate manhole lid 42, superior riser end 33, and surface layer thickness 113. It will be further understood that the conduit axis 29 and the skirt axis 49 are substantially collinear. The skirt gateway enables access to superior conduit end 27 via superior riser end 33 or the conduit (tank) access aperture defined thereby. Manhole lid 42 is preferably positionable in superior adjacency to manhole skirt 41 and substantially coplanar with superior surface layer 111. Further, manhole lid 42 is preferably centered at skirt axis 49, the superior portions of manhole skirt 41 function to center manhole lid 42 and the skirt diameter at the inferior portions of manhole skirt 41 are lesser in magnitude than the riser diameter. It will be readily understood that manhole lid 42 functions to enable selective access to superior conduit end 27 via the skirt gateway and superior riser end 33 (via the conduit or tank access aperture). In this last regard, it should be noted that manhole lid 42 is preferably of a bolt-down type for preventing unauthorized access to underground storage tank 21.

Figure 3:
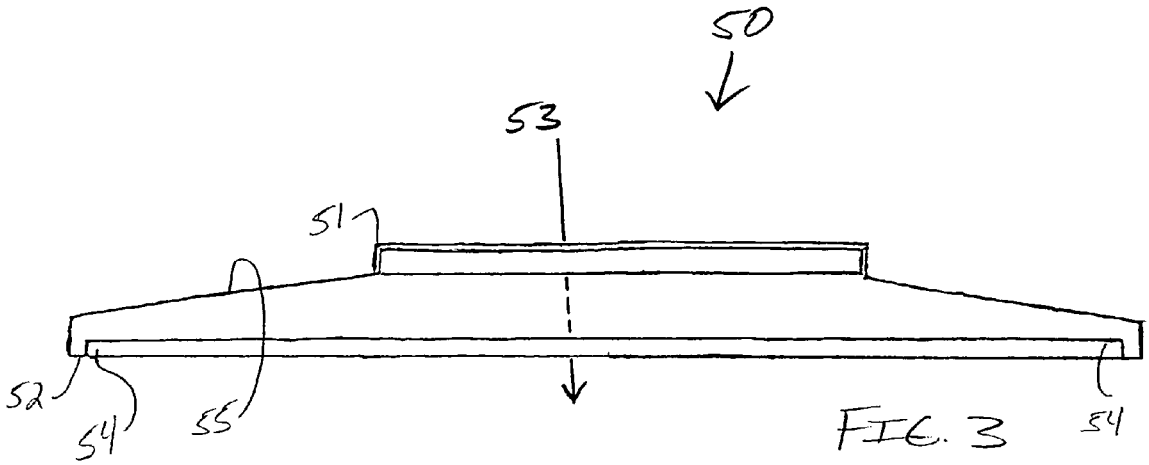
FIG. 3 is a fragmentary cross-sectional side view of an optional riser top cap reducer of the preferred storage tank access system.
Figure 4:
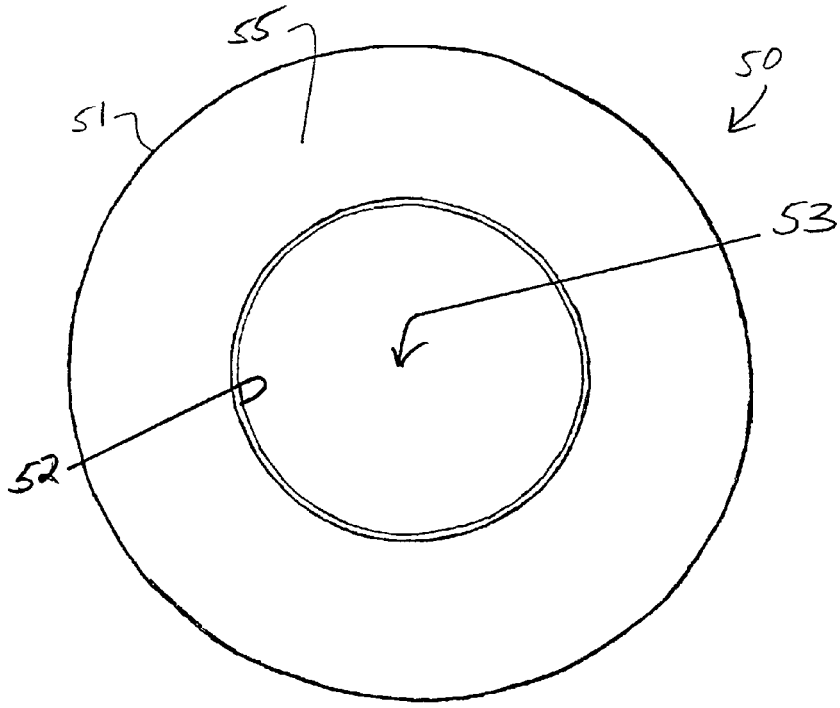
FIG. 4 is a top plan view of the optional riser top cap reducer shown in FIG. 3.

As earlier introduced, the storage tank access system 10 or kit may optionally comprise riser top cap reducer 50 as illustrated and referenced in FIGS. 1, 3 and 4. It will be seen from an inspection of the noted figures that riser top cap reducer 50 extends intermediate superior riser end 33 and superior surface layer 110 and thus, comprises a superior reducer end 51 as illustrated and referenced in FIGS. 3 and 4; an inferior reducer end 52 as illustrated and referenced in FIGS. 3 and 4; a reducer gateway 53 as illustrated and referenced in FIGS. 1, 3, and 4; and certain riser member-engagement portions 54 as referenced in FIG. 3. It will be seen from an inspection of the noted figures that superior reducer end 51 comprises a first transverse diameter, inferior reducer end 52 comprises a second transverse diameter, and that the second transverse diameter is greater in magnitude than the first transverse diameter. In other words, the outer reducer surface 55 slopes from superior reducer end 51 to inferior reducer end 52. Notably, the skirt diameter is greater in magnitude than the first transverse diameter, but lesser in magnitude than the second transverse diameter. Riser top cap reducer 50 primarily functions to isolate structure inwardly adjacent tot superior riser end 33, such as the conduit access aperture, from the backfill material 101.

In terms of the storage tank access kit, as contemplated by the current invention, it has been noted that underground storage tanks have sizes and shapes that are often unknown to the installer before the installer arrives at the site of installation. After arriving at the installation site, the underground storage tank size and shape must first be determined or provided. Implicit in this statement is that the various dimensions of the tank are readily determinable, for example by gauging or evaluating an exposed tank radius of curvature and extrapolating the tank radius from same. Given that storage tanks are often of unknown size when a field installation project starts, it is contemplated that the storage tank access kit for outfitting any number of variously sized underground storage tanks of the present invention fills a need in the art. In this regard, then, it is contemplated that storage tank access kit is designed to outfit a storage tank assembly (such as storage tank assembly 20) having a determinable tank radius (such as tank radius 25) and matter-conducting conduit (such as matter-conducting conduit 22). The storage tank access kit, when outfitted upon the underground storage tank 21, functions to both (1) enable access to the underground storage tank and (2) isolate the matter-conducting conduit 22 from backfill material 101.

It is thus contemplated that the storage tank access kit must essentially comprise access/isolation riser assembly 30. It will be recalled that access/isolation riser assembly 30 preferably comprises an access/isolation riser member 31, which member comprises superior riser end 33, inferior riser end 34, inner riser surface 35, and outer riser surface 36. Superior riser end 33 essentially defines a conduit or tank access aperture and outer riser surface 36 at inferior riser end 34 notably and critically comprises a plurality of oppositely-paired curvilinear score indicia 38 as a means to outfit storage tanks of varying diameters. The oppositely-paired curvilinear score indicia 38 each have a vertical radius of curvature (as earlier specified); which vertical radii of curvature enable a user to form a plurality of paired removable inferior end portions. The paired removable inferior end portions 105 comprise a select inferior end portion pairing (such as exemplary removable inferior end portions 105), which select inferior end portion pairing is selectable based upon the determinable tank radius.

The access/isolation riser assembly of the storage tank access kit may further comprise certain riser alignment spacer means for centering riser member 31 relative to the matter-conducting conduit, which conduit is in (often fluid) communication with the underground storage tank 21. The riser alignment spacer means may be defined by at least one riser alignment spacer assembly 32 wherein each alignment spacer assembly 32 comprises a cooperative riser periphery-engaging portion (such as riser-engaging portions 64, as combined), a cooperative conduit periphery-engaging portion (such as conduit-engaging portions 66, as combined), and means for uniformly and/or reinforcing the spacing intermediate the riser periphery-engaging portion and the conduit periphery-engaging portion (such as radial members 65 and/or spokes 67). It will be understood that the conduit periphery-engaging portion is thus cooperatively associated with the matter-conducting conduit 22 and the riser periphery-engaging portion is cooperatively associated with inner riser surface 35 for maintaining a substantially uniform spacing therebetween.

The storage tank access kit may further naturally comprise manhole assembly, wherein the manhole assembly comprises manhole skirt 41 and manhole lid 42. As assembled, the manhole skirt is extendable intermediate manhole lid 42, optional riser top cap reducer 50, and surface layer thickness 113. The conduit axis and the skirt axis are further alignable, as manhole assembly is outfitted upon the storage tank assembly 20. Notably, the skirt gateway enables access to matter-conducting conduit 22 via the optional riser top cap reducer 50 and superior riser end 33. Manhole lid is positionable in superior adjacency to manhole skirt 41, in centered relation thereto. The manhole lid 42 is designed to enable selective access to the matter-conducting conduit 22 via the skirt gateway, the (optional) riser top cap reducer and the superior riser end 33. The optional riser top cap reducer 50 is cooperatively associatable with superior riser end 33 for extending superiorly therefrom and providing a reducer gateway intermediate manhole skirt 41 and the tank or conduit access aperture.

It is noted that crossover conduit 80 often extends from underground storage tanks of the type herein described. In other words, conduit extending from underground storage tank 21 is not always linear and thus the axis of certain crossover conduit 80 may pass through the inner and outer riser surfaces 35 and 36 of riser member 31 as generally depicted in FIG. 12. In this regard, it is further contemplated that the storage tank access system or kit of the present invention may comprise a crossover conduit template 81 as generally illustrated and referenced in FIG. 6. Crossover conduit template 81 is preferably constructed from low cost pliable material such cardboard as comprises a plurality of variously dimensioned conduit pullouts 82 as further referenced in FIG. 6. The edges of each conduit pullout may be perforated for ease of selective removal. It is contemplated that conduit pullouts 82 preferably comprise a select conduit pullout 82(*s*), which select conduit pullout 82(*s*) is selected based upon the dimensions of crossover conduit 80, as cooperatively associated with underground storage tank 21. The select conduit pullout 82(*s*) may thus be positioned adjacent the outer riser surface 36 and functions to provide an outline for enabling a user to score the outer riser surface 36, which scoring further enables the user to more easily remove a scored portion 83 from riser member 31 as generally depicted in FIG. 12 (the scored portion 83 having been removed from riser member 31. It will be understood from an inspection of FIG. 12 that removable scored portion 83 enables crossover conduit 80 to extend intermediate the inner riser surface 35 and the outer riser surface 36.

More particularly, included with every access/isolation riser assembly is a cardboard template (crossover conduit template 81) of the same diameter as the outside diameter of the riser member 31. This cardboard template piece will have notched pull outs (pullouts 82) for various pipe or conduit diameters, such as 4", 3" 2", 1½", 1, ¾" and ½". The purpose of the cardboard template is essentially to allow the installer to use it as marking/measuring template should there be a piping crossover at the installation location of the riser member. The installer would mark the outside diameter of the cardboard template where the pipe crosses over and measure the height of pipe. The installer would then use the notched pullout, per pipe diameter, and height from tank top, to top of pipe, and mark from the base using measurements on the cardboard template, and up the side wall of the riser member using the notched pull out per pipe diameter. Once the mark has been made for the pipe, the marked area would be cut out. The next step would be to install the riser member on the underground storage tank. The cut out portion of the riser member would then be notched out for the pipe, and put back into place, using strips of polyethylene and self tapping screws. Finally the outside wall of the repaired cut out section would be taped using a pipe coating type tape or a heavy duty rubber tape. It is contemplated that the cardboard template may preferably be included to help the installer with measurements, and marking cut outs, in the event of a piping crossover at the location of the riser member installation.

It will thus be understood that the essential purpose for the access/isolation riser assembly is to provide easy access to the man-way plate installed on the top of new, and existing underground storage tanks. The access/isolation riser assembly further provides easy access to underground storage tanks that are repaired, or fiberglass lined. The access/isolation riser assembly further functions to isolate the backfill material that surrounds the underground storage tank and all of its components, thereby allowing easy access to the top of the tank and the main opening. Without the use of the access/isolation riser assembly, costly concrete cutting, breaking, removal, and excavation of back fill materials is otherwise necessary to reach the underground storage tank access main way. Another problem currently addressed by the present invention is the typical undermining of concrete slab surface layering caused by excavation. The access/isolation riser assembly and methodology of the present invention will allow easy access to the tank top through a manhole at finished grade level of the concrete slab that covers the top of the underground storage tank pit area.

Further, the access/isolation riser assembly functions to isolate the tank top riser pipes and electrical fittings from the backfill material, and thus, allows debris-free access to the matter-conducting conduit and/or storage tank through the manhole assembly. The access/isolation riser assembly form fits the top of the underground storage tank at installation to provide an effective means of keeping backfill materials out of the riser member. Notably, the riser member is not designed, nor meant to be liquid tight and will be permeated with ⅛" to 1/16" holes (apertures 108) for allowing ground water to flow freely through the walls of the riser member.

Field installation of the access/isolation riser assembly essentially consists of certain processes after locating the underground storage tank. The diameter or radius of the underground storage tank per application must be determined. Upon determining certain transverse cross-sectional dimensions of the underground storage tank, the installer would cut along the molded, and color coded cut lines per tank diameter at the base of the riser member using any number of tools, including, a saw all, jig saw, or a roto-zip tool. Once the cuts has been made, a saddle/harness that will form fit the underground tank diameter will be in place at the base of the riser member (not specifically illustrated). If an underground storage tank riser pipe is present, an alignment spacer would be screwed together at the base and top of said pipe, thus creating a means to hold the riser member in place during the application of backfill material. If an underground storage tank riser pipe is not present, the riser member would be held in place manually while backfill material is added around riser member.

The next step would be to determine the final grade "top of the concrete slab". Upon making the grade determination the installer would obtain the measurement from the top of the underground storage tank grade. Next, the installer would subtract the height of the optional riser top cap reducer, and 3" to 6" from the measurement obtained from the tank top to finished grade. The top portion of the riser member would then be marked and cut using a saws all, jig saw, or a roto-zip tool. The final step would be to install a manhole skirt and manhole lid centered over the top of the riser member and pour concrete around the manhole skirt. The top of the riser member or the top of the riser top cap reducer would need to be about 3" to 6" below the finished grade of the concrete, inside of the manhole cover, upon completion. The underground storage tank top manway, riser pipe, or electrical fittings will be easily and selectively accessible by removing the manhole cover or lid.

While the above description contains much specificity, this specificity should not be construed as limitations on the scope of the invention, but rather as an exemplification of the invention. For example, as is implicit in the foregoing descriptions the present disclosure may further be said to disclose a certain method for installing an underground storage tank access/isolation riser assembly, the method comprising a number of steps, including the provision of a riser member and certain riser alignment spacer means, wherein the riser member comprises a superior riser end, an inferior riser end, an outer riser surface, and an initial riser height 70 as generally depicted in FIG. 7. Outer riser surface 36 at inferior riser end 34 comprises certain curvilinear score indicia 38, which comprise a plurality of vertically paired radii of curvature. Given provision of the riser member and certain riser alignment spacer means, the installer or user may then proceed to locate an underground storage tank assembly, the underground storage tank assembly comprising a determinable tank radius, a matter-conducting conduit, and an outer tank surface. Once the tank assembly is located, the installer must determine the tank radius or curvature. The determined tank radius of curvature is matched to a select radii-of-curvature pairing, the select radii-of-curvature pairing being selected from the group consisting of the vertically paired radii of curvature. The installer then removes a certain inferior end portion pairing from the riser member at the select radii of curvature pairing, which forms an inferior riser end saddle-shaped mouth. The inferior riser end may then be saddled upon the outer tank surface radially adjacent to the matter-conducting conduit, the riser alignment spacer means centering the riser member relative to the matter-conducting conduit.

Should the superior portions of the storage tank be exposed, the tank may then be covered with backfill material after saddling the inferior riser end upon the outer tank surface. Preferably, the access/isolation riser assembly comprises saddle retainment means for fixing (or maintaining the position of) the riser member during the process of covering the exposed underground storage tank with backfill material. After covering the exposed storage tank with backfill material, a final surface layer grade is determined and the distance intermediate the outer tank surface adjacent the riser member to the final surface layer grade is calculated, thus providing a tank-to-surface dimension. Given a manhole skirt and a manhole lid, it is important to note that the manhole skirt inherently comprises a skirt height and the manhole lid inherently comprises a lid thickness. The skirt height and the lid thickness are then subtracted from the tank-to-surface height, thus providing a manhole-reduced tank-to-surface dimension.

Notably, the optional riser top cap reducer inherently comprises a reducer height. Should the riser top cap reducer be incorporated into the storage tank access assembly, the reducer height must then be subtracted from the manhole-reduced tank-to-surface dimension, thus providing a non-riser-reduced tank-to-surface height (i.e. the tank-to-surface height minus the collective height of non-riser elements, namely the sum of the skirt height, the lid height, and the reducer height). In this regard, it is noted that the superior riser end may comprise a removable superior end section 71 as illustrated and referenced in FIGS. 7 and 8. The removable superior end section 71 inherently has a superior sectional height as referenced at 72 in the noted figures. Notably, the superior sectional height 72 is equal to a select sectional dimension depending on whether the riser top cap reducer is incorporated into the design. Thus, the select sectional dimension is selected from the dimensional group consisting of a requisite select dimension and an optional select dimension. The requisite select dimension is equal to the difference between the manhole-reduced tank-to-surface dimension and the initial riser height and the optional select dimension is equal to the difference between the non-riser-reduced tank-to-surface dimension and the initial riser height. In other words, a certain section of the superior riser end may be removed or sectioned off in order to properly interconnect the operative components, much akin to plumbing conduit in that it, too, must often be sectioned so that the adjacent components properly provide a collaborative longitudinal channel or conduit. The removable superior end section 71 may then be removed from the superior riser end, providing a finally-formed superior riser end 73 as generally referenced in FIG. 8. Once the installation of select non-riser components is complete, certain skirt fixing material (such as concrete) may be positioned in radial adjacency to the manhole skirt and in superior adjacency to the backfill material for fixing (or maintaining the position of) the installed select non-riser elements. It will be noted that surface layer thickness 113 comprises or is constructed from the skirt fixing material.

In cases where crossover conduit 80 is present, the invention contemplates certain methodology whereby crossover conduit template 81 is provided. Crossover conduit template 81 comprises a plurality of variously dimensioned conduit pullouts 82, the conduit pullouts comprising a select conduit pullout 82(*s*). The select conduit pullout 82(*s*) may properly be selected after locating the underground storage tank assembly 20 and is selected based upon the dimensions of crossover conduit 80. The select conduit pullout 82(*s*) enables a user to score the outer riser surface 36 and remove a scored portion 84 from riser member 31, which removal is generally referenced at 84 in FIG. 12. The removable scored portion 83 enables crossover conduit 80 to extend intermediate the inner riser surface 35 and the outer riser surface 36.

Notably, the scored portion 83 is removed from riser member 31 before saddling inferior riser end upon outer tank surface 23. The removed scored portion thus forms a conduit-receiving slot 85, which conduit-receiving slot 85 comprises a conduit passage 86 and a conduit-receiving aperture 87 as further depicted in FIG. 12. The removed scored portion 83 may then be scored again or twice scored (89) at a patch portion 88, the twice-scored patch portion 88 for patching conduit passage 86. The twice-scored patch portion 88 may then be removed from the removed scored portion 83 and reattached to riser member 31 after saddling inferior riser end 34 upon outer tank surface 23. The reattached twice-scored patch portion 88 thus patches conduit passage 86 and crossover conduit 80 extends intermediate inner riser surface 35 and outer riser surface 36 via the conduit-receiving aperture 87.

Thus, although the invention has been described by reference to a preferred embodiment, it is not intended that the novel kit be limited thereby, but that modifications thereof are intended to be included as falling within the broad scope and spirit of the foregoing disclosure, the following claims and the appended drawings.

I claim:

1. A storage tank access system, the storage tank access system for enabling access to underground storage, the storage tank access system being cooperatively associated with an underground system-receiving cavity, the underground system-receiving cavity being spatially located intermediate inferior backfill material and a superior surface layer, the superior surface layer comprising a superior layer surface, an inferior layer surface, and a surface layer thickness, the surface layer thickness extending intermediate the superior and inferior layer surfaces, the storage tank access system comprising, in combination:

an underground storage tank assembly, the underground storage tank assembly comprising a storage tank, the storage tank comprising an outer tank surface, an inner tank surface, and a substantially circular transverse tank cross-section, the transverse tank cross-section comprising a tank radius of curvature; and an access/isolation riser assembly, the access/isolation riser assembly comprising a cylindrically-shaped access/isolation riser member, the access/isolation riser member comprising a superior riser end, an inferior riser end, an inner riser surface, an outer riser surface, a substantially uniform riser diameter, and a longitudinal riser axis, the superior riser end defining a tank access aperture, the outer riser surface at the inferior riser end comprising a plurality of paired curvilinear score indicia and first and second lateral vertices, the score indicia extending intermediate the first and second lateral vertices, the score indicia being paired based upon a plurality of angles of inclination, the angles of inclination extending intermediate the inferior riser end and the curvilinear score indicia at the first and second lateral vertices, the curvilinear score indicia enabling a user to remove paired inferior end portions from the inferior riser end, the removed paired end portions forming a tank-engaging, saddle-shaped mouth at the inferior riser end, the tank-engaging, saddle-shaped mouth comprising a vertical riser radius of curvature, the vertical riser radius of curvature being substantially equal to the tank radius of curvature, the tank-engaging, saddle-shaped mouth being engageable with the outer tank surface.

2. The storage tank access system of claim 1 comprising a manhole assembly, the manhole assembly comprising a cylindrical manhole skirt and a substantially circular manhole lid, the manhole skirt comprising an inferior skirt end, a superior skirt end, a skirt gateway, a longitudinal skirt axis, and a skirt diameter, the manhole lid comprising a lid diameter and a lid center, the manhole skirt extending intermediate the manhole lid, the superior riser end, and the surface layer thickness, the riser and skirt axes being substantially collinear, the skirt gateway enabling access to the tank access aperture, the manhole lid being positioned in superior adjacency to the manhole skirt substantially coplanar with the superior layer surface, the manhole lid being centered at the skirt axis, the manhole lid for enabling selective access to the tank access aperture via the skirt gateway.

3. The storage tank access system of claim 1 comprising a matter-conducting conduit and riser alignment spacer means, the matter-conducting conduit comprising a superior conduit end, an inferior conduit end, and a longitudinal conduit axis, the matter-conducting conduit extending superiorly and radially outward from the outer tank surface, the inferior conduit end being in communication with the inner tank surface, the matter-conducting conduit for conducting matter intermediate the inner tank surface and the superior conduit end, the tank-engaging, saddle-shaped mouth being engageable with the outer tank surface in radial adjacency to matter-conducting conduit, the riser alignment spacer means centering the riser member relative to the conduit axis, the riser and conduit axes thus being substantially collinear, the access/isolation riser member and riser alignment spacer means for isolating the matter-conducting conduit from the backfill material.

4. The storage tank access system of claim 2 wherein the access/isolation riser assembly comprises a riser top cap reducer, the riser top cap reducer extending intermediate the superior riser end and the superior surface layer, the riser top cap reducer comprising a superior reducer end, an inferior reducer end, and a reducer gateway, the superior reducer end comprising a first transverse diameter, the inferior end comprising a second transverse diameter, the second transverse diameter being greater in magnitude than the first transverse diameter, the riser top cap reducer for isolating the conduit access aperture from the backfill.

5. The storage tank access kit of claim 4 wherein the skirt diameter is greater in magnitude than the first transverse diameter and lesser in magnitude than the second transverse diameter, the riser diameter being greater in magnitude than the skirt diameter and the first transverse diameter.

6. The storage tank system of claim 3 wherein the riser alignment spacer means are defined by at least one riser alignment spacer assembly, each alignment spacer assembly comprising first and second spacer members and spacer attachment means, the first and second spacer members each comprising a semicircular riser-engaging portion, a conduit-engaging portion, and spacer attachment means, the spacer attachment means attaching the spacer members to one another, the conduit-engaging portions, the riser-engaging portions and the spacer attachment means.

7. The storage tank access system of claim 6 comprising a superior riser alignment spacer assembly and an inferior riser alignment spacer assembly, the superior riser alignment spacer assembly being spatially located in inferior adjacency to the superior conduit end and the inferior riser alignment spacer assembly being spatially located in superior adjacency to the inferior conduit end.

8. The storage tank access system of claim 6 wherein each spacer member comprises spacer reinforcement means, the spacer reinforcement means for maintaining a uniform distance intermediate the riser-engaging portions and the conduit-engaging portions.

9. The storage tank access system of claim 1 wherein the riser member comprises water permeation means, the water permeation means for allowing water to permeate intermediate the inner riser surface and the outer riser surface.

10. The storage tank access system of claim 1 wherein the score indicia are color coded for enabling the user to more easily remove the paired inferior end portions.

11. The storage tank access system of claim 1 comprising a crossover conduit template, the crossover conduit template comprising a plurality of variously dimensioned conduit pullouts, the conduit pullouts comprising a select conduit pullout, the select conduit pullout being selected based upon the dimensions of a crossover conduit, the crossover conduit being cooperatively associated with the underground storage tank, the select conduit pullout for enabling a user to score the outer riser surface and remove a scored portion from the riser member, the removable scored portion for enabling the crossover conduit to extend intermediate the inner riser surface and the outer riser surface.

12. A storage tank access kit, the storage tank access kit for outfitting an underground storage tank assembly having a determinable tank radius of curvature, the storage tank access kit, when outfitted upon the underground storage tank, for enabling access to the underground storage tank, the storage tank access kit comprising an access/isolation riser assembly, the access/isolation riser assembly comprising an access/isolation riser member, the access/isolation riser member comprising a superior riser end, an inferior riser end, an inner riser surface, and an outer riser surface, the superior riser end defining a tank access aperture, the outer riser surface at the inferior riser end comprising a plurality of oppositely-paired curvilinear score indicia, the oppositely-paired curvilinear score indicia each having a vertical radius of curvature, the vertical radii of curvature enabling a user to form a plurality of paired removable inferior end portions, the paired removable inferior end portions comprising a select inferior end portion pairing, the select inferior end portion pairing being selectable based upon the determinable tank radius of curvature.

13. The storage tank access kit of claim 12 wherein the access/isolation riser assembly comprises riser alignment spacer means, the riser alignment spacer means for centering the riser member relative to a matter-conducting conduit in communication with the underground storage tank, the riser member for enabling outfitted access to the underground storage tank and for isolating the matter-conducting conduit from backfill material.

14. The storage tank access kit of claim 13 wherein the riser alignment spacer means are defined by at least one riser alignment spacer assembly, each alignment spacer assembly comprising a cooperative riser periphery-engaging portion, a cooperative conduit periphery-engaging portion, and means for uniformly spacing the riser periphery-engaging portion from the conduit periphery-engaging portion, the conduit periphery-engaging portion being cooperatively associated with the matter-conducting conduit and the riser periphery-engaging portion being cooperatively associated with the inner riser surface.

15. The storage tank access kit of claim 14 comprising a superior riser alignment spacer assembly and an inferior riser alignment spacer assembly, the superior riser alignment spacer assembly being spatially locatable in inferior adjacency to the superior riser end and the inferior riser alignment spacer assembly being spatially locatable in superior adjacency to the inferior riser end.

16. The storage tank access kit of claim 14 wherein each spacer member comprises spacer reinforcement means, the spacer reinforcement means for maintaining a uniform distance intermediate the riser periphery-engaging portion and the conduit periphery-engaging portion.

17. The storage tank access kit of claim 12 wherein the access/isolation riser assembly comprises a riser top cap reducer, the riser top cap reducer cooperatively associatable with the superior riser end for extending superiorly therefrom, the riser top cap reducer comprising a superior reducer end, an inferior reducer end, and a reducer gateway, the superior reducer end comprising a first transverse diameter, the inferior end comprising a second transverse diameter, the second transverse diameter being greater in magnitude than the first transverse diameter, the riser top cap reducer for isolating the tank access aperture from backfill material.

18. The storage tank access kit of claim 17 comprising a manhole assembly, the manhole assembly comprising a manhole skirt and a manhole lid, the manhole skirt comprising an inferior skirt end, a superior skirt end, a skirt gateway, and a longitudinal skirt axis, the manhole lid comprising a lid center, the manhole skirt extendable intermediate the manhole lid, the riser top cap reducer, and the surface layer thickness, the longitudinal conduit and skirt axes being alignable, the skirt gateway for enabling access to the matter-conducting conduit via the riser top cap reducer and the superior riser end, the manhole lid being positionable in superior adjacency to the manhole skirt and substantially coplanar with a superior surface layer, the manhole lid being centerable at the skirt axis, the manhole lid for enabling selective access to the matter-conducting conduit via the skirt gateway, the riser top cap reducer and the superior riser end.

19. The storage tank access kit of claim 12 wherein the riser member comprises water permeation means, the water permeation means for allowing water to permeate intermediate the inner riser surface and the outer riser surface.

20. The storage tank access kit of claim 12 comprising a color code key, the score indicia being cooperatively color coded per the color code key for enabling the user to more easily remove the paired inferior end portions.

21. The storage tank access kit of claim 12 comprising a crossover conduit template, the crossover conduit template comprising a plurality of variously dimensioned conduit pullouts, the conduit pullouts comprising a select conduit pullout, the select conduit pullout being selected based upon the dimensions of a crossover conduit, the crossover conduit being cooperatively associated with the underground storage tank, the select conduit pullout for enabling a user to score the outer riser surface and remove a scored portion from the riser member, the removable scored portion for enabling the crossover conduit to extend intermediate the inner riser surface and the outer riser surface.

22. A method for installing an underground storage tank access/isolation riser assembly, the method comprising the steps of:

providing a riser member, the riser member comprising a superior riser end, an inferior riser end, an outer riser surface, and an initial riser height, the outer riser surface at the inferior riser end comprising curvilinear score indicia, the curvilinear score indicia comprising a plurality of vertically paired radii of curvature;

locating an exposed underground storage tank assembly, the exposed underground storage tank assembly comprising a determinable tank radius and an outer tank surface;

determining the tank radius;

matching the tank radius to a select radii of curvature pairing, the select radii of curvature pairing being selected from the group consisting of the vertically paired radii of curvature;

removing an inferior end portion pairing from the riser member at the select radii of curvature pairing, the removed inferior end portion pairing forming a inferior riser end saddle; and saddling the inferior riser end upon the outer tank surface radially adjacent to the matter-conducting conduit, the riser alignment spacer means centering the riser member relative to the matter-conducting conduit.

23. The method of claim 22 wherein riser alignment spacer means are provided, the riser alignment spacer means for centering the riser member relative to a matter-conducting conduit, the inferior riser end being saddled upon the outer tank surface in radial adjacency to the matter-conducting conduit.

24. The method of claim 23 wherein the exposed underground storage tank is covered with backfill material after saddling the inferior riser end upon the outer tank surface, the access/isolation riser assembly comprising saddle retainment means, the saddle retainment means for fixing the riser member during the step of covering the exposed underground storage tank with backfill material, the riser member and riser alignment spacer means for allowing access to the matter-conducting conduit and the superior riser end and for isolating the matter-conducting conduit from the backfill material.

25. The method of claim 24 wherein a final surface layer grade is determined after covering the exposed underground storage tank with backfill material.

26. The method of claim 25 wherein the distance from the outer tank surface adjacent the riser member to the final surface layer grade is measured, thus providing a tank-to-surface dimension.

27. The method of claim 26 wherein the access/isolation riser assembly comprises a manhole skirt and a manhole lid, the manhole skirt comprising an inferior skirt end, a superior skirt end, a skirt gateway, and a skirt height, the manhole lid comprising a lid thickness, the manhole skirt extendable intermediate the manhole lid and the superior riser end, the skirt gateway for enabling access to the matter-conducting conduit via the superior riser end, the manhole lid being positionable in superior adjacency to the manhole skirt and substantially coplanar with a superior surface layer, the manhole lid for enabling selective access to the matter-conducting conduit via the skirt gateway and the superior riser end, the skirt height and the lid thickness being subtracted from the tank-to-surface dimension, thus providing a manhole-reduced tank-to-surface dimension.

28. The method of claim 27 wherein the access/isolation riser assembly comprises a riser top cap reducer, the riser top cap reducer cooperatively associatable with the superior riser end for extending superiorly therefrom, the riser top cap reducer comprising a superior reducer end, an inferior reducer end, a reducer gateway, and a reducer height extending intermediate the superior and inferior reducer ends, the riser top cap reducer for isolating the matter-conducting conduit from backfill material intermediate the manhole skirt and the superior riser end, the reducer height being subtracted from the manhole-reduced tank-to-surface dimension, thus providing a non-riser-reduced tank-to-surface dimension.

29. The method of claim 28 wherein the superior riser end comprises a removable superior end section, the superior end section having a superior sectional height, the superior sectional height being equal to a select sectional dimension, the select sectional dimension being selected from the group consisting of a requisite sectional dimension and an optional sectional dimension, the requisite select dimension being equal to the difference between the manhole-reduced tank-to-surface dimension and the initial riser height, the optional sectional dimension being equal to the difference between the non-riser-reduced tank-to-surface dimension and the initial riser height, the removable superior end section being removed from the superior riser end, thus providing a finally-formed superior riser end.

30. The method of claim 29 wherein select non-riser elements are installed intermediate the superior riser end and the final surface layer grade after providing the finally-formed superior riser end, the select non-riser elements being selected from the group consisting of the manhole assembly and the riser top cap reducer.

31. The method of claim 30 wherein skirt fixing material is positioned in radial adjacency to the manhole skirt in superior adjacency to the backfill material after installing the select non-riser elements, the skirt fixing material for fixing the installed select non-riser elements.

32. The method of claim 22 wherein the a crossover conduit template is provided, the crossover conduit template comprising a plurality of variously dimensioned conduit pullouts, the conduit pullouts comprising a select conduit pullout, the select conduit pullout being selected after locating the underground storage tank assembly, the select conduit pullout being selected based upon the dimensions of a crossover conduit, the crossover conduit being cooperatively associated with the underground storage tank, the select conduit pullout for enabling a user to score the outer riser surface and remove a scored portion from the riser member, the removable scored portion for enabling the crossover conduit to extend intermediate the inner riser surface and the outer riser surface.

33. The method of claim 32 wherein the scored portion is removed from the riser member before saddling the inferior riser end upon the outer tank surface, the removed scored portion thus forming a conduit-receiving slot, the conduit-receiving slot comprising a conduit passage and a conduit-receiving aperture.

34. The method of claim 33 wherein the removed scored portion is twice scored at a patch portion, the twice-scored patch portion for patching the conduit passage, the twice-scored patch portion being removed from the removed scored portion.

35. The method of claim 34 wherein the removed twice-scored patch portion is reattached to the riser member after saddling the inferior riser end upon the outer tank surface, the reattached twice-scored patch portion thus patching the conduit passage, the crossover conduit extending intermediate the inner riser surface and the outer riser surface via the conduit-receiving aperture.

* * * * *